US009512693B2

(12) United States Patent
Derby

(10) Patent No.: US 9,512,693 B2
(45) Date of Patent: Dec. 6, 2016

(54) HYDRAULIC SET PACKER WITH PISTON TO ANNULUS COMMUNICATION

(71) Applicant: Weatherford/Lamb, Inc., Houston, TX (US)

(72) Inventor: Michael C. Derby, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 311 days.

(21) Appl. No.: 14/173,307

(22) Filed: Feb. 5, 2014

(65) Prior Publication Data

US 2014/0216764 A1 Aug. 7, 2014

Related U.S. Application Data

(60) Provisional application No. 61/762,263, filed on Feb. 7, 2013.

(51) Int. Cl.
*E21B 33/128* (2006.01)

(52) U.S. Cl.
CPC ..... *E21B 33/1285* (2013.01)

(58) Field of Classification Search
CPC ..... E21B 33/1285; E21B 23/06
See application file for complete search history.

(56) References Cited

U.S. PATENT DOCUMENTS 5,152,340 A 10/1992 Clark et al.
6,612,372 B1 9/2003 Freiheit et al.
8,087,458 B2 1/2012 Birner
2010/0051293 A1 3/2010 Ezell et al.
2011/0186307 A1* 8/2011 Derby ..... E21B 33/1285 166/386

FOREIGN PATENT DOCUMENTS

CN 2861470 Y 1/2007
CN 2900771 Y 5/2007
CN 101392636 A 3/2009
CN 101852070 A 10/2010
(Continued)

OTHER PUBLICATIONS

First Office Action in counterpart Russian Appl. 2014104215, dated Apr. 13, 2015.

(Continued)

*Primary Examiner* — David Andrews
(74) *Attorney, Agent, or Firm* — Blank Rome LLP

(57) ABSTRACT

A hydraulically set packer has a mandrel with an internal bore and a port communicating the internal bore outside the mandrel. A packing element disposed on the mandrel can be compressed by a piston to engage the borehole. The piston is disposed on the mandrel on a first side of the packing element and moves against the packing element when tubing pressure is communicated into a first piston chamber via the mandrel's port. To increase the setting forces, a sleeve disposed between the packing element and the mandrel defines a space communicating an opposite side of the packing element with a second pressure chamber of the piston. During high pressure operations, high pressure on the first side of the packing element acts with high pressure on the first side of the piston, increasing the pistons movement from a high pressure region to a low pressure region.

23 Claims, 3 Drawing Sheets

(56) References Cited

FOREIGN PATENT DOCUMENTS

| | | | |
|---|---|---|---|
| EP | 0566290 | A1 | 10/1993 |
| RU | 1819321 | C | 5/1993 |
| RU | 2208127 | C1 | 7/2003 |
| RU | 2292442 | C1 | 1/2007 |
| RU | 2305170 | C2 | 8/2007 |
| SU | 1745882 | A1 | 7/1992 |

OTHER PUBLICATIONS

Decision on Grant in counterpart Russian Appl. 2014104215, dated Sep. 16, 2015.
Weatherord International Ltd., Packer Systems Brochure 2606.00, "PFH and PFHL Hydraulic/Hydrostatic Packers," © 2007.
Weatherord International Ltd., Packer Systems Brochure 2570.02, "BlackCat™ TH Hydraulic-Set Production Packer," © 2008-2010.
Weatherord International Ltd., Packer Systems Brochure 2594.02, "Hydrow IV Hydraulic-Set Production Packer," © 2008.
Weatherord International Ltd., Packer Systems Brochure 2637.01, "WH-6 Hydraulic-Set Retrievable Packer," © 2005-2007.
Weatherord International Ltd., Packer Systems Brochure 2632.01, "UltraPak HU Permanent Hydraulic-Set Seal-Bore Packer," © 2008-2010.
Weatherord International Ltd., Packers Catalog Brochure 667.03, "Discover Premium Performance," © 2005-2010.
Weatherord International Ltd., Packer Systems Brochure 2591.00, "Hydrow I Hydraulic Production Packer," © 2008.
Weatherord International Ltd., Packer Systems Brochure 2625.01, "ThunderCat Hydraulic-Set Retrievable Production Packer," © 2008-2009.
Weatherord International Ltd., Openhole Completions Brochure 7178.02, "ComboFrac Openhole Packer 4-1/2×6-1/4/ in.," © 2009-2011.
Weatherord International Ltd., Openhole Completions Brochure 8311.02, "ARES Hydraulic Openhole Packer," © 2010.
Weatherord International Ltd., Packer Systems Brochure 7819.01, "UltraPak ZS Permanent Hydraulic-Set Packer," © 2010-2012.
Weatherord International Ltd., Openhole Completions Brochure 9662.01, "ZoneFrac Openhole Packer," © 2012.
First Office Action in counterpart Chinese Appl. 201410045347.8, mailed Feb. 3, 2016.
Second Office Action in counterpart Chinese Appl. 201410045347.8, mailed Oct. 17, 2016, 17-pgs.

* cited by examiner

HYDRAULIC SET PACKER WITH PISTON TO ANNULUS COMMUNICATION

CROSS-REFERENCE TO RELATED APPLICATION

This application claims the benefit of U.S. Prov. Appl. 61/762,263, filed 7 Feb. 2013, which is incorporated herein by reference.

BACKGROUND OF THE DISCLOSURE

In a staged frac operation, multiple zones of a formation need to be isolated sequentially for treatment. To achieve this, operators install a frac assembly 20 as shown in FIG. 1 at the wellbore 10. Typically, the assembly 20 has a top liner packer (not shown) supporting a tubing string 12 in the wellbore 10. Packers 50 isolate the wellbore into zones 14, and various sliding sleeves 40 on the tubing string 12 can selectively communicate the tubing string 12 with the various zones 14. When the zones 14 do not need to be closed after opening, operators may use single shot sliding sleeves 40 for the frac treatment. These types of sleeves 40 are usually ball-actuated and lock open once actuated. Another type of sleeve 40 is also ball-actuated, but can be shifted closed after opening.

Initially, all of the sliding sleeves 40 are closed. Operators then deploy a setting ball to close a wellbore isolation valve (not shown), which seals off the downhole end of the tubing string 12. At this point, the packers 50 are hydraulically set by pumping fluid with a pump system 35 connected to the wellbore's rig 30. The tubing pressure in the tubing string 12 actuates the packers 50 to isolate the annulus into the multiple zones 14. With the packers 50 set, operators rig up fracturing surface equipment and pump fluid down the tubing string 12 to open a pressure actuated sleeve (not shown) further downhole so a first zone 14 can be treated.

As the operation continues, operators drop successively larger balls down the tubing string 14 to open successive sleeves 40 and pump fluid to treat the separate zones 14 in stages. When a dropped ball meets its matching seat in a sliding sleeve 40, fluid is pumped by the pump system 35 down the tubing string 12 and forced against the seated ball. The pumped fluid forced against the seated ball shifts the sleeve 40 open. In turn, the seated ball diverts the pumped fluid out ports in the sleeve 40 to the surrounding wellbore 10 between packers 50 and into the adjacent zone 14 and prevents the fluid from passing to lower zones 14. By dropping successively increasing sized balls to actuate corresponding sleeves 40, operators can accurately treat each zone 14 up the wellbore 10.

FIGS. 2A-2B show two examples of hydraulically set, open hole packers 50A-50B according to the prior art. Looking first at FIG. 2A, the packer 50A has a mandrel 52 with an internal bore 53 passing therethrough that connects on a tubing string (12: FIG. 1). Ends of the mandrel 52 have end rings 56 and 58 disposed externally thereon, and the internal bore 53 of the mandrel 52 has flow ports 54*a*, 54*b* for communicating fluid outside the mandrel 52.

A piston 60 disposed externally on the mandrel 52 has a ratchet mechanism 66, such as a body lock ring, on one end for locking movement of the piston 60. The other end 61 of the piston 60 compresses the packing element 70 against the fixed end ring 58 on the mandrel 52 when the piston 60 is actuated.

To actuate the packer 50A hydraulically, fluid communicated down the mandrel's bore 53 enters a piston chamber 64*a* between the inside of the piston 60 and the mandrel 52 via a flow port 54*a*. The buildup of tubing pressure inside the chamber 64*a* slides the piston 60 along the mandrel 52 and forces the piston's end 61 against the packing element 70, which extends outward toward the surrounding borehole wall 15 when compressed.

As the piston chamber 64*a* increases in volume with the movement of the piston 60, the ratchet mechanism 66 locks against a serrated surface on the mandrel 52 and prevents reverse motion of the piston 60. Additionally, a volume 62 between the piston 60 and the mandrel 52 decreases with the movement of the piston 60, and fluid can escape to the borehole annulus 16 via an external port 63.

The packer 50A in FIG. 2A can have a double-piston arrangement as shown. In this case, a second piston 68 can also be moved by tubing pressure collecting in another piston chamber 64*b* via another flow port 54*b*. This second piston 68 also acts against the packing element 70 to extend it outward toward the surrounding borehole wall 15.

The packer 50B in FIG. 2B is similar to that discussed above with reference to FIG. 2A so that the same reference numerals are used between similar components. This packer 50B in FIG. 2B has a two-stage activation of the packing element 70. When tubing pressure is supplied down the mandrel's bore 53 and into the piston chamber 64, the pressure moves a first-stage setting mandrel 65 under the packing element 70 and increases the element's outer diameter.

Once the setting mandrel 65 fully extends between the packing element 70 and the mandrel 52 with the distal end of the mandrel 65 even reaching inside the fixed end ring 58, the second stage of the packer 50B is initiated as the piston 60 is now moved by the communicated pressure. The end 61 of the piston 60 compresses the packing element 70 against the fixed end ring 58, causing the element 70 to extend outward and seal against the borehole wall 15. As before, the body lock ring of the ratchet mechanism 66 locks the piston 60 into position so the packer 50B can hold differential pressure from above and below.

The hydraulic pistons 60 in the hydraulically-set packers 50A-50B, such discussed above and used in the fracture system 20 of FIG. 1, only apply setting force to the packing element 70 when there is tubing pressure in the packer mandrel 52 and no significant pressure in the uphole and downhole annuli surrounding the packer 50A-B.

SUMMARY OF THE DISCLOSURE

A hydraulically-set packer has a mandrel with an internal bore and an internal port communicating the internal bore outside the mandrel. A packing element disposed on the mandrel can be compressed by a piston to engage the borehole. The piston is disposed on the mandrel on a first side of the packing element and moves against the packing element when tubing pressure is communicated into a first piston chamber via the mandrel's internal port.

To increase the setting forces, a bypass communicates a second, opposite side of the packing element with a second piston chamber of the piston. For example, a sleeve can be disposed between the packing element and the mandrel and can define a space communicating the second, opposite side of the packing element with the second pressure chamber of the piston. During high pressure operations, the lower annulus pressure from the opposite (e.g., uphole) side of the packing element can act against a second (back) side of the piston, while the higher tubing pressure acts against the first (e.g., downhole) side of the piston.

In a particular implementation, the pressures can act against two sides of a seal member of the piston. As this occurs, the acting pressures increase the piston's movement from a high pressure region to a low pressure region. Additionally, annulus pressure from a fracture or other operation can also act in concert with the communicated tubing pressure to compress the packing element.

The foregoing summary is not intended to summarize each potential embodiment or every aspect of the present disclosure.

DETAILED DESCRIPTION OF THE DISCLOSURE

Figure 3A:
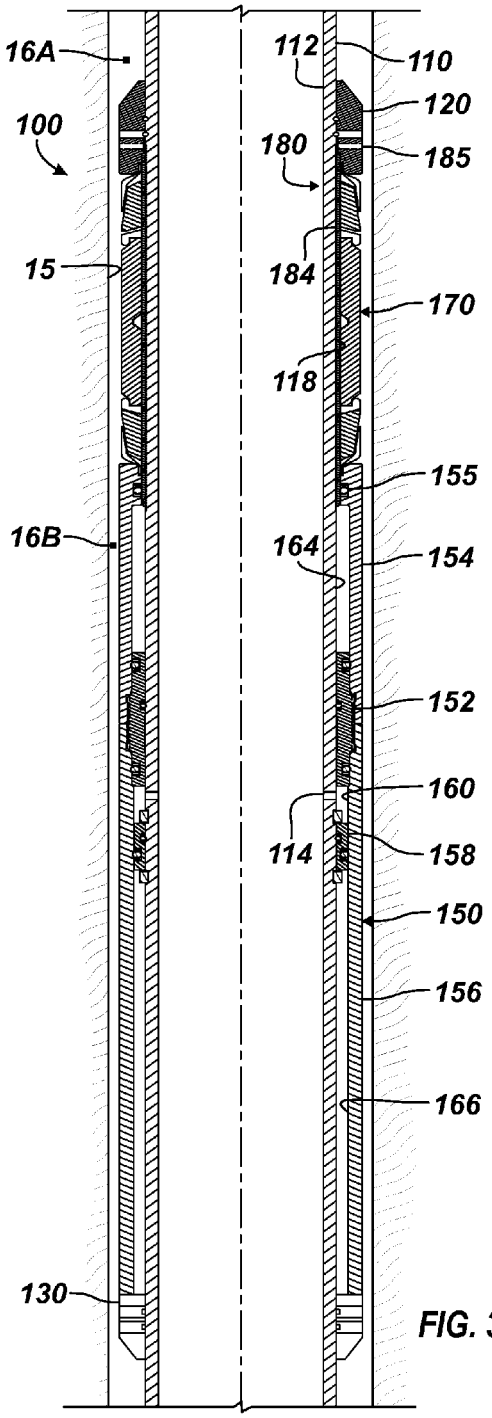
FIG. 3A illustrates a cross-section of a hydraulically set, open hole packer according to the present disclosure in an unset condition.

As noted previously, the hydraulic piston in current hydraulic set packers, such as an openhole packer, only applies setting force to the packing element when there is tubing pressure in the packer's mandrel and no significant pressure in the uphole and downhole annuli. In contrast to such conventional packers, a hydraulically set, open hole packer illustrated in FIGS. 3A-3B allows setting force from the packer's hydraulic piston 150 to be applied to the packer's packing element 170 when there is tubing pressure (in the packer's mandrel 110) as well as pressure in one of the uphole and downhole annuli. As will also be detailed below, the disclosed packer 100 allows pressure from the pressurized annulus to add to the setting force on the packing element 170.

Figure 1:
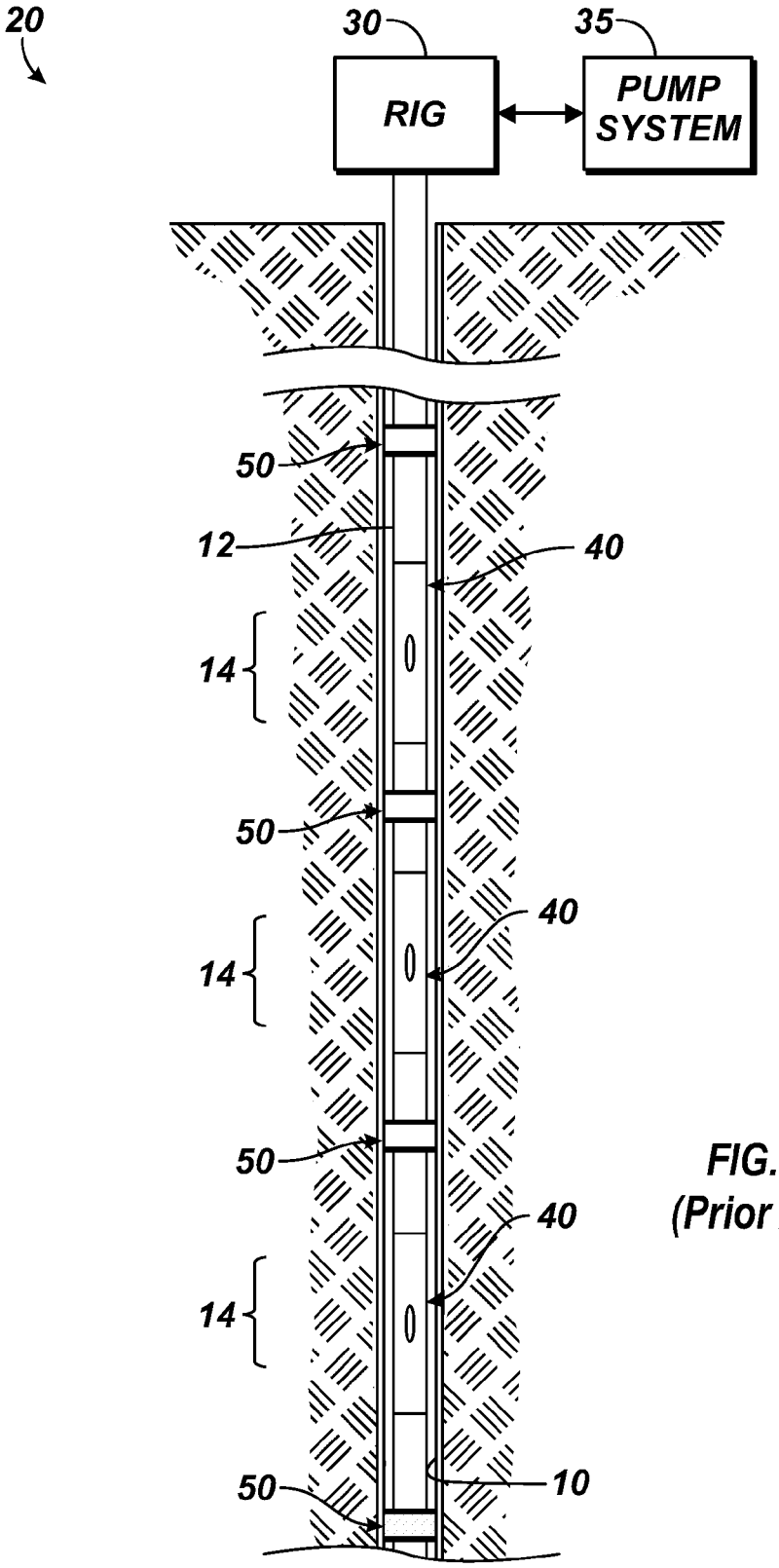
FIG. 1 (Prior Art)
FIG. 1 diagrammatically illustrates a tubing string having multiple sleeves and openhole packers of a fracture system.

The packer 100 has a mandrel 110 with an internal bore 112 passing therethrough that connects on a tubing string (12: FIG. 1). The mandrel 110 also has one or more internal ports 114 communicating the internal bore 112 outside the mandrel 110, as detailed below. Ends of the mandrel 110 have end rings 120 and 130 disposed externally thereon, and a packing element 170 disposed on the mandrel 110 is compressible to engage a surrounding borehole wall 15.

A piston 150 is disposed on the mandrel 110 on a first (e.g., downhole) side of the packing element 170. As detailed below, the piston 150 in this embodiment has a seal member 152, a piston cylinder 156, and a cylinder end 154 connected together to form the piston 150, although other configurations could be used. The piston 150 defines first and second piston chambers 160 and 164 with the mandrel 110.

The first piston chamber 160 communicates with the one or more internal ports 114 in the mandrel 110 to receive tubing pressure communicated through the packer's mandrel 110 during packer setting procedures and other operations, such as a fracture operation if applicable. A fluid pressure bypass 180 communicates a second (e.g., uphole) side of the packing element 170 with the second piston chamber 164 of the piston 150. As detailed below, the bypass 180 communicates annulus pressure in the annulus 16A on one side (e.g., uphole) of the packing element 170 to the second chamber 164.

To set the packer 100 hydraulically, the piston 150 (including the seal member 152, the cylinder end 154, and the piston cylinder 156) moves against the packing element 170 with first fluid pressure communicated to the first piston chamber 160 via the internal ports 114 and with second fluid pressure communicated to the second piston chamber 164 via the fluid pressure bypass 180. The first fluid pressure (i.e., the tubing pressure) may be the typical pressure used to set a packer and can be about 4,000-psi plus the hydrostatic head. The second fluid pressure may simply be the annulus pressure or hydrostatic head in the wellbore.

Looking at the setting procedure in more detail, the piston 150 has the movable seal member 152 that seals against the mandrel 110 and has the cylinder end 154 and the piston cylinder 156 coupled on each side of the movable seal member 152. The piston cylinder 156 can abut against one of the fixed end rings 130 on the mandrel 110, and the cylinder end 154 abuts against the packing element 170 of the packer 100.

The inside of the piston cylinder 156 seals against a fixed seal member 158 disposed on the mandrel 110 so that the piston 150 forms the two piston chambers 160 and 164. As noted above, the first piston chamber 160 communicates with the mandrel's internal bore 112 via the one or more internal ports 114. During setting, first fluid pressure (i.e., the tubing pressure) supplied from the surface down the tubing string and the mandrel's bore 112 enters the first piston chamber 160 via the one or more internal ports 114 and acts against one side of the movable seal member 152 of the piston 150. The applied tubing pressure thereby moves the piston 150 along the mandrel 110 as the first piston chamber 160 increases in volume.

Figure 3B:
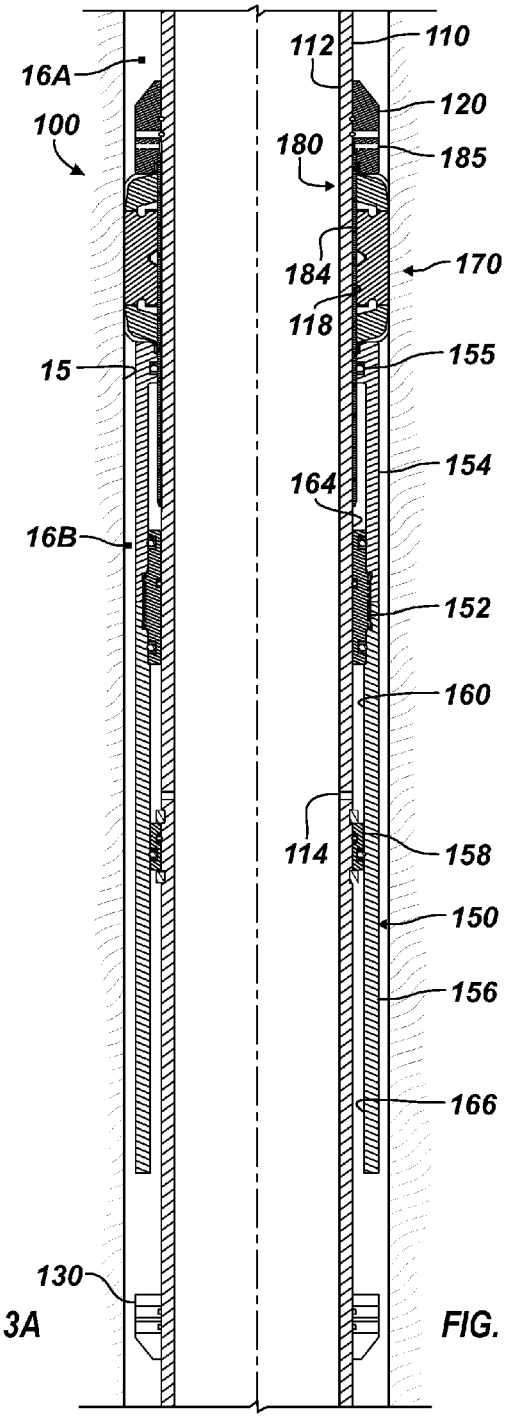
FIG. 3B illustrates a cross-section of the hydraulically set, open hole packer according to the present disclosure in a set condition.

As a result, the cylinder end 154 of the piston 150 is forced against the packing element 170 and compresses it against the fixed end ring 120. In turn, the packing element 170 extends outward to the surrounding borehole wall 15 as it compresses. As shown in FIG. 3B, the compressed element 170 seals the borehole into a first annulus 16A and a second annulus 16B, which can be either uphole or downhole depending on the orientation of the packer 100 in the borehole 10. As shown here, the first annulus 16A is depicted as the uphole annulus 16A of the borehole.

As hinted to above, the packer 100 of the present disclosure allows the tubing pressure in the packer's mandrel 110 as well as pressure in the borehole annuli 16A-16B to work together to set the packing element 170. To do this, pressure from the first (e.g., uphole) annulus 16A communicates via the fluid pressure bypass 180 with one (uphole) side of the piston 150 (i.e., with the backside of the seal member 152) so that the tubing pressure and the pressure in the second (downhole) annulus 16B can act on the same side of the packing element 170 and work together to further set the element 170. The benefit of having these pressures act together can be beneficial during fracture treatments or the like, as discussed below. Overall, by having these pressures work together, the total setting force on the packing element 170 can be increased and can further ensure proper setting and isolation.

To communicate the pressure from the first (uphole) annulus 16A to the backside of the seal member 152, the fluid pressure bypass 180 has a sleeve 184 that fits on the mandrel 110 underneath the packing element 170. The sleeve 184 defines a gap, a space, or an annular region around or along the exterior of the mandrel 110 that allows for fluid communication between the sleeve 184 and the mandrel 110. As an additional feature, longitudinal grooves 118, slots, or the like can be defined on the exterior surface of the mandrel 110 under the surrounding sleeve 184 to facilitate fluid communication in the space between the sleeve 184 and mandrel 110.

During use, fluid pressure (i.e., annulus pressure of the hydrostatic head) in the first (uphole) annulus 16A can communicate via ports 182 in the top end ring 120 to the sleeve 184 and can communicate via the gap and optional grooves 118 between the sleeve 184 and mandrel 110 to the second pressure chamber 164 of the piston 150. A seal 155 on the distal end of the cylinder end 154 engages the outside of the sleeve 184 so that the communicated annulus pressure can be contained in the second pressure chamber 164 and can act against the backside of the seal member 152.

As can be seen, the volume of the first piston chamber 160 increases as the piston 150 moves against the packing element 170. Meanwhile, the volume of the second piston chamber 164 stays substantially the same as the piston 150 moves against the packing element 170 and the cylinder end 154 moves over more of the sleeve 184.

The communication of the first (uphole) annulus pressure via the ports 182, sleeve 184, and second pressure chamber 164 allows pressure to equalize during the setting procedure, as the higher tubing pressure in the first chamber 160 acts against one side of the movable seal member 152 and the lower annulus pressure in the second chamber 164 acts against the other side of the movable seal member 152 to move the piston 150. The pressures allow the piston 150 to capture additional setting pressure as it moves from a high pressure region towards a lower pressure region.

It is also expected that pressure in the second (downhole) annulus 16B can act against the packing element 170 to act further to set the packing element 170. In particular, during a fracture treatment, the tubing pressure in the mandrel's bore 112 may be increased to 10,000 psi or more because this pressure is communicated to the downhole annulus 16B via a sliding sleeve or the like (see e.g., sleeve 40 in FIG. 1). The pressure in the downhole annulus 16B along with the pressure in the piston chamber 160 will have increased and act further against the packing element 170 and piston 150 to compress the element 170.

Figure 2A:
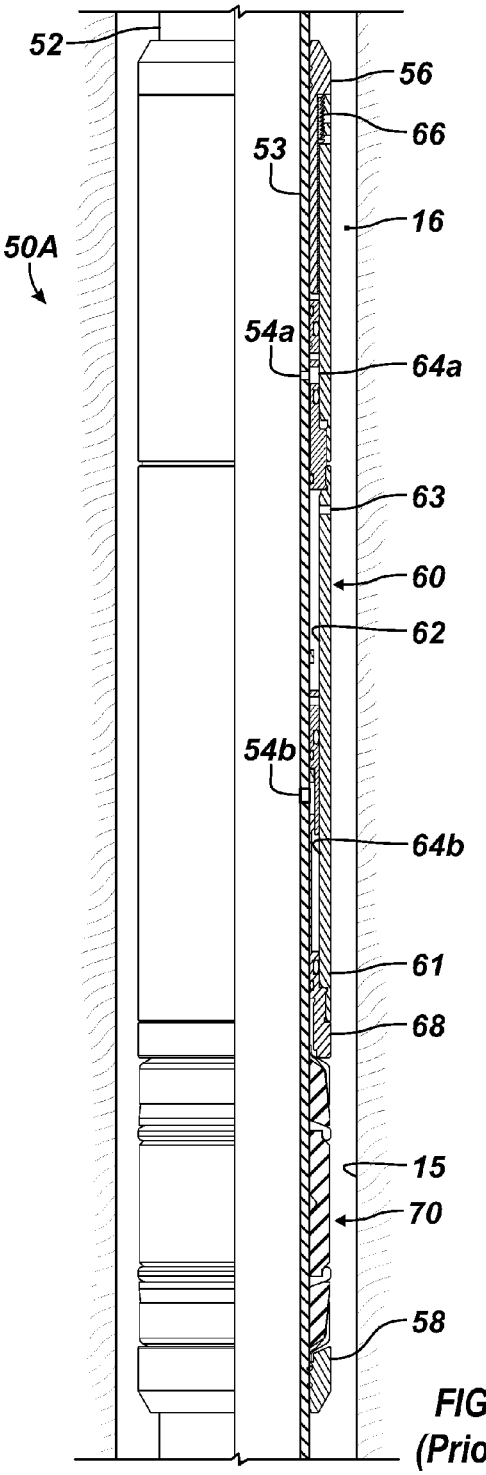
FIG. 2A (Prior Art)
FIG. 2A illustrates a partial cross-section of a hydraulically set, open hole packer according to the prior art.
Figure 2B:
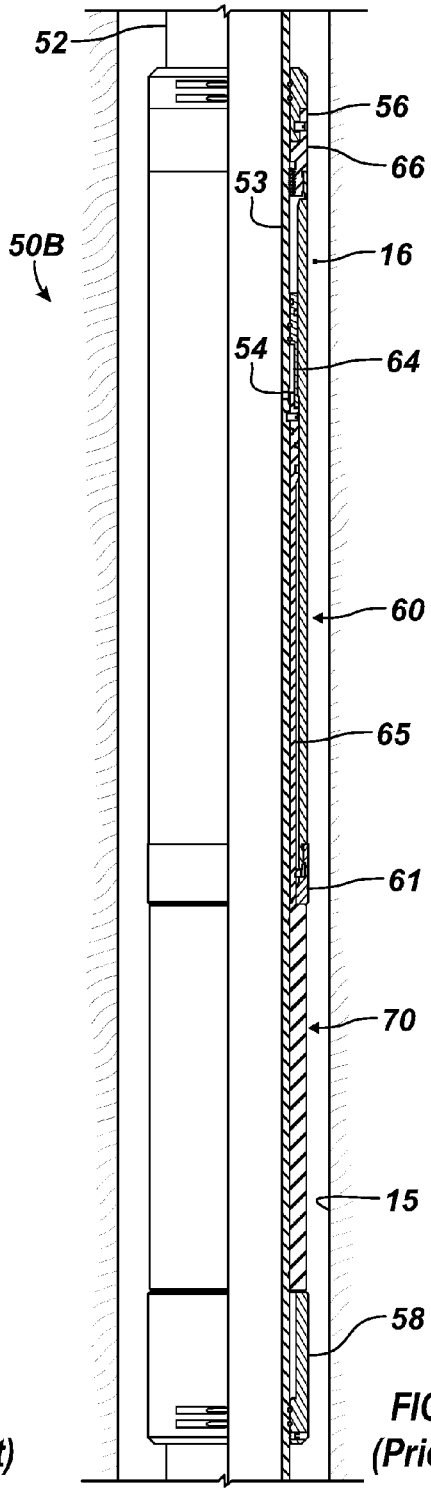
FIG. 2B (Prior Art)
FIG. 2B illustrates a partial cross-section of another hydraulically set, open hole packer according to the prior art.

Although not expressly shown, it will be appreciated that the packer 100 can have any other conventional features used on a downhole packer. For example, a ratchet mechanism (not shown), such as a body lock ring 66 depicted in FIGS. 2A-2B, can be disposed between the piston cylinder 156 or piston end 154 and the mandrel 110 to lock the movement of the piston 150 on the mandrel 110 toward the packing element 170. The packer 100 can have any type of packing element 170 disposed thereon and which can having one or more sleeves, anti-extrusion rings, and the like, which can be composed of suitable materials, such as elastomer, plastic, metal, or the like. The various components of the packer 100 can be composed of materials conventionally used for such downhole components.

Finally, although the packer 100 has been described as an open hole packer used for fracture operations, the packer 100 based on the teachings of the present disclosure can be a cased hole packer and can be used for any number of downhole operations in a wellbore.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A hydraulically set packer for setting in an annulus of a borehole, the packer comprising:

a mandrel having an internal bore and an internal port communicating the internal bore outside the mandrel;

a packing element disposed on the mandrel and being compressible to engage the borehole;

a piston disposed on the mandrel on a first side of the packing element and defining first and second piston chambers, the first piston chamber being sealed and communicating exclusively with the internal bore via the internal port; and a bypass communicating a second side of the packing element with the second piston chamber of the piston, the second piston chamber being sealed and communicating exclusively with the second side of the packing element via the bypass.

2. The packer of claim 1, wherein the piston is movable against the packing element in response to first fluid pressure communicated to the first piston chamber via the internal port.

3. The packer of claim 1, wherein the packing element is further compressible in response to annulus pressure communicated on the first side of the packing element.

4. The packer of claim 1, wherein the piston is movable against the packing element in response to second fluid pressure communicated to the second piston chamber via the bypass.

5. The packer of claim 4, wherein the bypass comprises a sleeve disposed on the mandrel, the sleeve defining a space with an exterior of the mandrel for communicating the second fluid pressure with the second pressure chamber.

6. The packer of claim 5, wherein the mandrel defines at least one groove in the exterior of the mandrel along the defined space.

7. The packer of claim 5, wherein the bypass comprises an end ring disposed on the mandrel on the second side of the packing element, the end ring having an external port communicating the annulus of the borehole with the defined space between the sleeve and the mandrel.

8. The packer of claim 5, wherein the piston comprises a seal sealing against the sleeve and containing the second piston chamber.

9. The packer of claim 1, wherein the piston comprises a first seal sealing against an exterior surface of the mandrel and dividing the first and second piston chambers.

10. The packer of claim 9, wherein the first seal comprises a seal member affixed to an interior surface of the piston and being movable with the piston.

11. The packer of claim 9, wherein the mandrel comprises a second seal sealing against an interior surface of the piston and containing the first piston chamber.

12. The packer of claim 11, wherein the second seal comprises a seal member affixed to an exterior surface of the mandrel with the interior surface of the piston movable relative thereto.

13. The packer of claim 1, wherein a first volume of the first piston chamber increases as the piston moves against the packing element.

14. The packer of claim 1, wherein a second volume of the second piston chamber stays substantially the same as the piston moves against the packing element.

15. The packer of claim 1, wherein the first side of the packing element is disposed downhole in the borehole, and wherein the second side of the packing element is disposed uphole in the borehole.

16. A hydraulically set packer for setting in an annulus of a borehole, the packer comprising:

a mandrel having an internal bore and an internal port communicating the internal bore outside the mandrel;

a packing element disposed on the mandrel and being compressible to engage the borehole;

a sleeve disposed between the packing element and the mandrel and defining a space communicating with first and second sides of the packing element; and a piston disposed on the mandrel on the first side of the packing element, the piston movable against the packing element and defining first and second piston chambers, the first piston chamber being sealed and communicating exclusively with the internal bore via the internal port in the mandrel, the second piston chamber being sealed and communicating exclusively with the space defined by the sleeve.

17. A method of hydraulically setting a packer in an annulus of a borehole, the method comprising:

deploying a packer downhole;

exclusively communicating tubing pressure in the packer to a first portion of a piston sealably disposed on a first side of a packing element on the packer;

exclusively communicating annulus pressure outside the packer at a second side of the packing element to a second portion of the piston sealably disposed on the first side of the packing element; and moving the piston against the packing element in response to the communicated pressure.

18. The method of claim 17, wherein communicating the tubing pressure to the first portion of the piston comprises communicating the tubing pressure to a first pressure chamber of the piston via an internal port of an internal bore in the packer.

19. The method of claim 18, wherein communicating the annulus pressure at the second side of the packing element to the second portion of the piston comprises communicating the annulus pressure to a second pressure chamber of the piston via a bypass under the packing element.

20. The method of claim 19, wherein communicating the tubing pressure to the first pressure chamber comprises increasing a first volume of the first piston chamber as the piston moves against the packing element, and wherein communicating the annulus pressure to the second pressure chamber comprises maintaining a second volume of the second piston chamber as the piston moves against the packing element.

21. The method of claim 19, wherein communicating the annulus pressure to the second pressure chamber of the piston via the bypass under the packing element comprises forming a space under the packing element with a sleeve disposed between the mandrel and the packing element.

22. The method of claim 19, wherein communicating the annulus pressure to the second pressure chamber of the piston via the bypass under the packing element comprises communicating the annulus of the borehole with the bypass via an external port on the second side of the packing element.

23. The method of claim 17, further comprising moving the piston against the packing element in response to annulus pressure on the first side of the packing element.

* * * * *